US006543529B2

(12) United States Patent
Ohgaki

(10) Patent No.: US 6,543,529 B2
(45) Date of Patent: Apr. 8, 2003

(54) FORCED AIR-COOLING CONDENSER

(75) Inventor: Masahiro Ohgaki, Koga (JP)

(73) Assignee: Sanoh Industrial Co., Ltd., Koga ( * ) Notice: Subject to any disclaimer, the term of this patent is extended or adjusted under 35 U.S.C. 154(b) by 0 days.

(21) Appl. No.: 09/950,693

(22) Filed: Sep. 13, 2001

(65) Prior Publication Data

US 2002/0185267 A1 Dec. 12, 2002

(30) Foreign Application Priority Data

Jun. 7, 2001 (JP) ..... 2001-171864

(51) Int. Cl.[7] ..... F28F 1/32

(52) U.S. Cl. ..... 165/171; 165/146; 165/109.1; 165/121

(58) Field of Search ..... 165/146, 171, 165/121, 109.1

(56) References Cited

U.S. PATENT DOCUMENTS 2,620,170 A * 12/1952 Brickman ..... 165/150
2,687,625 A * 8/1954 Nadler ..... 165/128
2,940,737 A * 6/1960 Sandberg ..... 165/171
3,159,213 A * 12/1964 Wurtz ..... 165/171
3,162,023 A * 12/1964 Smith ..... 62/155
3,388,562 A * 6/1968 Harle ..... 165/133
3,976,126 A * 8/1976 Ruff ..... 165/110
4,574,444 A * 3/1986 Humpolik ..... 165/178
5,502,983 A * 4/1996 Dasher ..... 165/150
6,178,770 B1 * 1/2001 Bradley et al. ..... 165/172

FOREIGN PATENT DOCUMENTS

JP 60-175992 A * 9/1985 ..... 165/151

* cited by examiner

*Primary Examiner*—Allen Flanigan
(74) *Attorney, Agent, or Firm*—Varndell & Varndell, PLLC

(57) ABSTRACT

A compact forced air-cooling condenser is provided which is overall of light weight, but can be manufactured inexpensively, and which is of high heat exchange performance. In a forced air-cooling condenser employed in a refrigerator of the type which forcibly cools the coolant condensing the coolant using a cooling fan, a condenser 1 for forced air-cooling is constituted of a construction in which a large number of heat-radiating wires 3 are attached extending across above and below a coolant pipe 2 that is bent back in bellows fashion in the same plane, and this is then as a whole bent into spiral shape.

8 Claims, 14 Drawing Sheets

(a)

(b)

FORCED AIR-COOLING CONDENSER

BACKGROUND OF THE INVENTION

1. Field of the Invention

The present invention relates to a condenser for forced air cooling and in particular relates to a forced air-cooling condenser that is used in a refrigerator of a construction wherein a condenser arranged at the bottom of the refrigerator is forcibly cooled by the blowing action of a cooling fan.

2. Description of the Related Art

Conventionally, refrigerators exist in which a freezer compartment and the refrigerator compartment etc are constituted within a thermally insulated box; the interior of the compartments is cooled by arranging an evaporator of a cooling device within the freezer compartment, and arranging the compressor and/or condenser of the cooling device within a machinery compartment constituted at the bottom of the thermally insulated box; these are arranged to be forcibly cooled by blowing external air into this machinery compartment, using a blower.

FIG. 14 shows a cross-sectional view of the portion of a machinery compartment 102 of a refrigerator 101 of this type.

In this Figure, an external air intake port 103 is formed on the right-hand side of the rear face of machinery compartment 102 and an external air exhaust port 104 is formed on the left-hand side of the rear face. Condenser 105 of the cooling device is arranged on the right-hand side within this machinery compartment 102, and compressor 106 of the cooling device is arranged on the left-hand side. Also, a blower (cooling fan) 108 operated by motor 107 is arranged between condenser 105 and compressor 106.

In the construction as described above, when motor 107 of blower 108 is operated, external air is taken in from intake port 103 of machinery compartment 102, and passes through condenser 105 to cool this condenser 105. After this, the external air reaches compressor 106 through blower 108, cooling this compressor 106, after which it is evacuated from exhaust port 104 (the flow of external air (cooling air current) in this process is shown by arrows in FIG. 14). By this means, condenser 105 and compressor 106 are forcibly air-cooled by external air.

Condenser 105 that is forcibly air-cooled as described above may also be a so-called auxiliary condenser arranged so as to supplement the cooling performance of another, main condenser (not shown).

As the forcibly cooled condenser (also including an auxiliary condenser) described above, a condenser 111 of the construction shown in FIG. 15 or a condenser 121 of the construction shown in FIG. 16 were generally used conventionally.

The condenser 111 shown in FIG. 15 was called a skin type condenser, and had a construction in which iron plates 113 were welded between coolant pipes 112 that were bent back a plurality of times in a bellows shape in the same plane, these being as a whole bent into a spiral shape.

In contrast, condenser 121 shown in FIG. 16 was called a spiral fin type condenser; in this condenser, thin sheet 123 was wound with a prescribed pitch onto the periphery of a cooling pipe 122, which was into bellows shape.

However, in the skin type condenser 111, the flow of air (flow of cooling air current) is fixed in a single direction parallel with iron plates 113 (direction shown by the white arrow in FIG. 15), and a construction in which there is a turbulent flow effect of the cooling air current is difficult to achieve.

Consequently, the heat exchange performance achieved by contact with the cooling air current is poor and in order to obtain the necessary amount of heat exchange, it is necessary to design the iron plates constituting the heat-radiating fins to be of large size; as a result, the total weight of the condenser becomes large and it becomes expensive.

Also, in spiral fin type condenser 121 described above, it was difficult to achieve a compact condenser, since cooling pipe 122 could not be bent in bellows fashion with a small radius of curvature, owing to the obstruction presented by the thin sheet 123 wound on to the periphery of the cooling pipe 122. Also, the operation of winding thin sheet 123 on to coolant pipe 122 was not straightforward, resulting in poor productivity.

SUMMARY OF THE INVENTION

The present invention was made in view of the problems of the skin type or spiral fin type condensers used in refrigerators of the type in which the condenser is forcibly air-cooled as described above, its object being to provide a compact condenser for forced cooling of small overall weight, which is inexpensive to manufacture, and which has high heat exchange performance.

In order to achieve the above object, according to the present invention, a forced air-cooling condenser employed in a refrigerator of the type wherein the condenser in which the coolant is condensed is subjected to forced air-cooling using a cooling fan is constructed such that a large number of heat-radiating wires are attached extending across above and below a coolant pipe that is bent back in bellows fashion in the same plane, and this is then as a whole bent into spiral shape or bent into bellows shape.

With a forced air-cooling condenser according to the present invention as described above, since wires are employed as the so-called heat-radiating fins, the overall weight can be reduced compared with a condenser of the skin type, and the coolant pipe can be bent with a smaller radius of curvature than with a condenser of the spiral fin type. Furthermore, since the coolant pipe is bent back in bellows fashion in the same plane and this is then as a whole bent in spiral fashion or bellows fashion, the benefit is obtained that a condenser can be obtained which is compact and yet has high heat exchange performance.

In the present invention: the heat-radiating wires may be attached alternately above and below the coolant pipe; the cross-section of the coolant pipe may be elliptical; the diameter of the heat-radiating wire may be 1.6 mm or less and the pitch of attachment of these heat-radiating wires to the coolant pipe may be 3 to 7 mm; also, the ends of the heat-radiating wires may project on the side of the cooling pipe positioned at both ends; furthermore, there may be provided means for stirring the flow of this cooling air current at a location on the inlet side to the condenser of the cooling air current formed by the cooling fan; and the attachment of the heat-radiating wires to the cooling pipe may be dense in the middle region where the cooling current formed by the cooling fan flows easily and sparse at the edges where the cooling current flows with difficulty; these are all desirable embodiments in that a condenser of high cooling performance by forced air-cooling is thereby produced.

DESCRIPTION OF THE PREFERRED EMBODIMENTS

Embodiments of a forced air-cooling condenser according to the present invention as described above are described in detail below with reference to drawings; however, the present invention is not restricted to the embodiments described below in any way.

Figure 1:
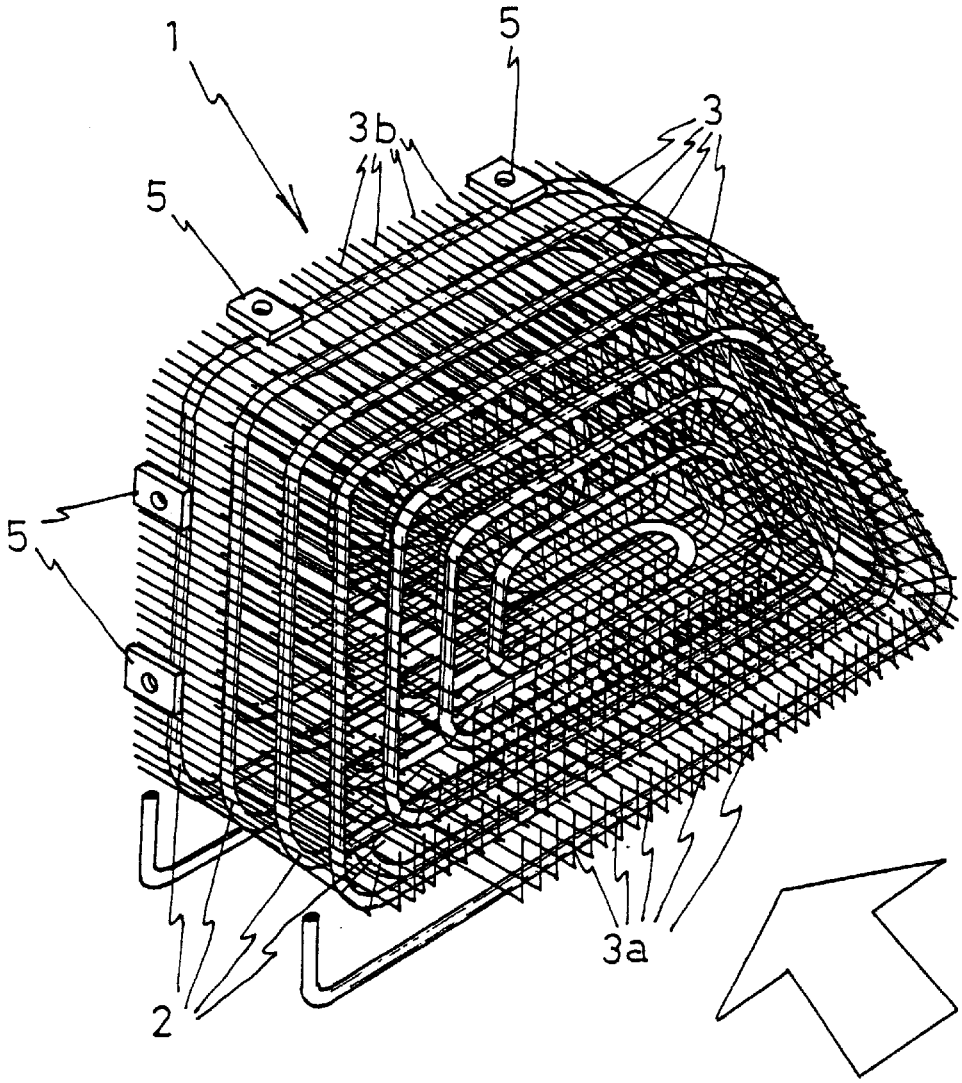
FIG. 1 is a perspective view illustrating a first embodiment of a forced air-cooling condenser according to the present invention.

FIG. 1 is a perspective view illustrating a first embodiment of a forced air-cooling condenser according to the present invention.

Figure 2:
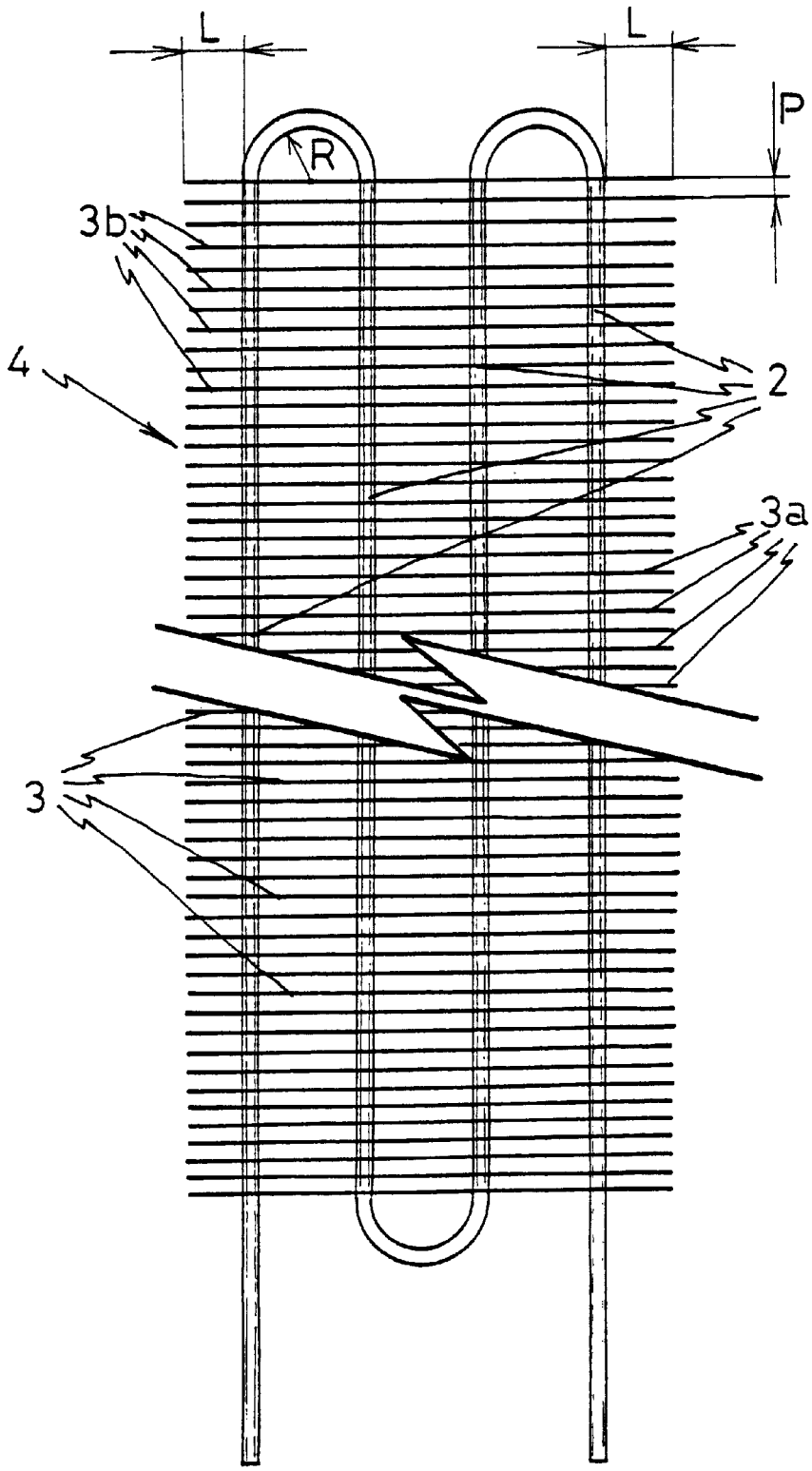
FIG. 2 is a plan view illustrating one condition in the process of manufacturing the condenser of FIG. 1 for forced air-cooling according to the present invention.

In this condenser 1 for forced air-cooling, as shown in FIG. 2, a large number of heat-radiating wires 3 extend across, above and below coolant pipe 2, which is bent back three times in bellows shape in the same plane, the regions of contact between coolant pipe 2 and heat-radiating wires 3 being fixed by welding; first of all a flat plate-shaped condenser 4 is produced, then this flat plate-shaped condenser 4 is successively bent in positions separated by a prescribed distance in the same direction from above as shown in FIG. 2 and, as shown in FIG. 1, as a whole is thereby constituted as a frustrum-shaped condenser of spiral form.

In attachment of the heat-radiating wires 3 to coolant pipe 2, as shown in FIG. 2, the ends 3*a* and 3*b* of heat-radiating wires 3 are attached in a condition projecting at the side of coolant pipe 2 positioned at both respective ends thereof. In this way, the length of heat-radiating wires 3 can be increased, and the heat-radiating portion thereof can be increased.

As shown in FIG. 2, the projecting lengths L of the respective ends 3*a* and 3*b* of these heat-radiating wires 3 are preferably made at least 0.5 times the radius of curvature R when coolant pipe 2 is bent in bellows fashion.

Figure 3:
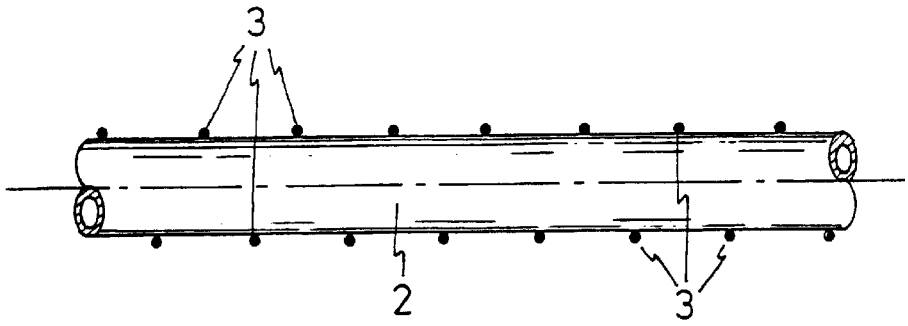
FIG. 3 is a side view illustrating the condition in which heat-radiating wires are added to the coolant pipe of the condenser of FIG. 1 for forced air-cooling according to the present invention.

Also, as shown in FIG. 3, the attachment of heat-radiating wires 3 to coolant pipe 2 is such that heat-radiating wires 3 are positioned alternately above and below coolant pipe 2 i.e. are attached underneath between heat-radiating wires 3 which are attached on top. In this way, the heat-radiating wires 3 that are attached above and below coolant pipe 2 both easily come into contact with the cooling air current and the benefit of stirring of the flow of the cooling air current is obtained; thus, the heat exchange performance of the condenser can be improved.

Also, coolant pipe 2 may be subjected to flattening processing using rollers etc to make it elliptical in cross section. The heat-radiating wires 3 are then attached above and below as shown in FIG. 4(*a*) or (*b*) to this coolant pipe 2 of elliptical cross section.

Figure 4:
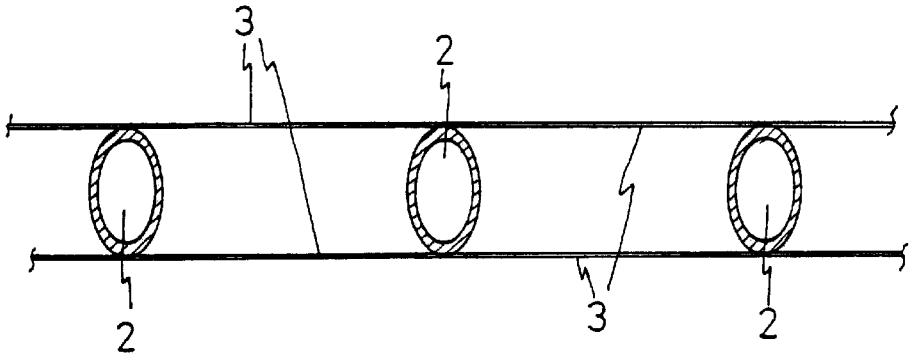
FIGS. 4(*a*) and 4(*b*) are cross-sectional views illustrating the cross-sectional shape of the coolant of FIG. 1 a for forced air-cooling according to the present invention.
Figure 4:
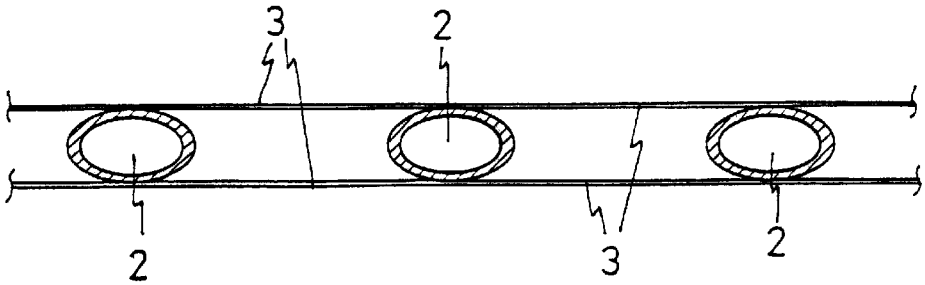

As shown in FIG. 4(*a*), when heat-radiating wires 3 are attached above and below in a condition with coolant pipe 2 of elliptical cross section arranged in erect fashion, a separation can be provided between the upper and lower heat-radiating wires, facilitating flow of cooling air current between the upper and lower heat-radiating wires and thereby enabling the heat exchange performance of the condenser to be increased.

Also, if, as shown in FIG. 4(*b*), the heat-radiating wires 3 are attached above and below in a condition in which coolant pipe 2 of elliptical cross section is arranged transversely, the area of contact between heat-radiating wires 3 and coolant pipe 2 is increased, making possible uninterrupted heat conduction from coolant pipe 2 to heat-radiating wires 3 and thereby of course enabling the heat exchange performance of the condenser to be improved.

The heat-radiating wires 3 that are attached to coolant pipe 2 are formed of metal of good thermal conductivity, such as iron, copper or aluminum. Also, the diameter of heat-radiating wires 3 is 1.6 mm or less and these are attached with a pitch P of 3 to 7 mm with respect to coolant pipe 2.

This is because, in the case of thick wires whose diameter exceeds 1.6 mm, their weight becomes large and bending processing becomes difficult. Also, if the pitch P with which these are attached to cooling pipe 2 is less than 3 mm, the resistance to the cooling air current becomes large, making it difficult for the cooling air current to flow. On the other hand, if the separation is opened out, exceeding 7 mm, this is undesirable since the number of heat-radiating wires that can be attached is decreased, adversely affecting the heat exchange performance of the condenser.

Figure 5:
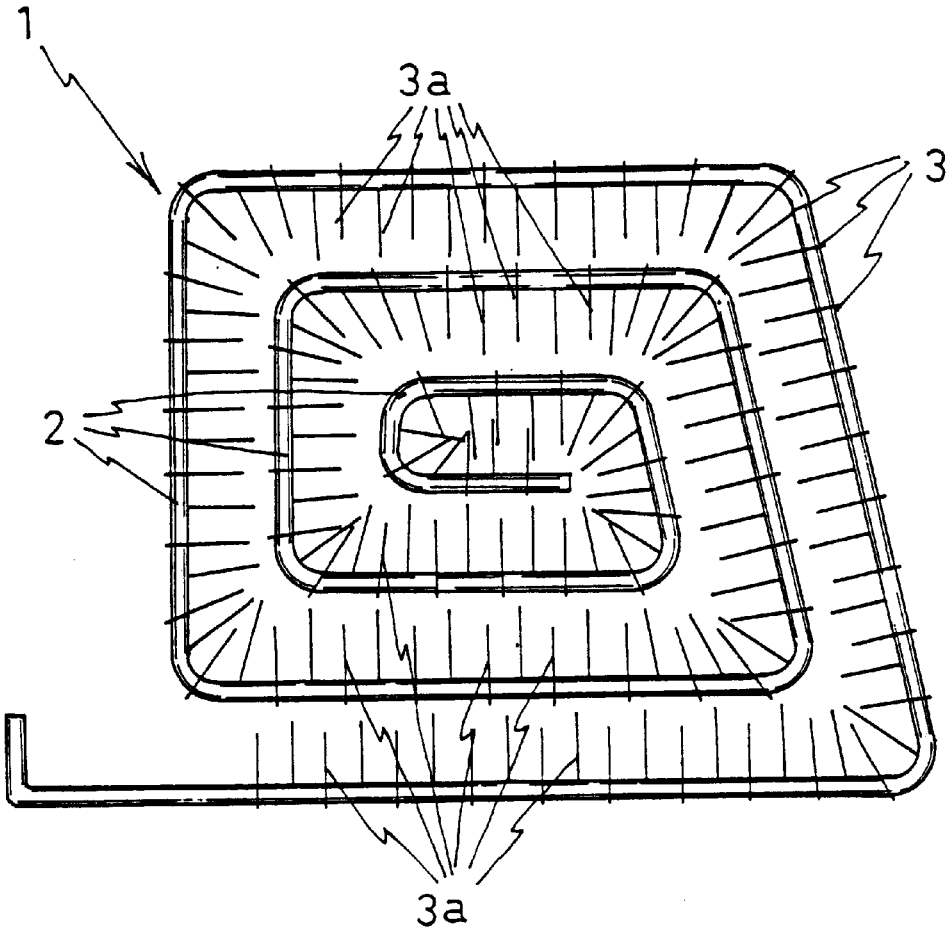
FIG. 5 is a front view of the condenser of FIG. 1 for forced air-cooling according to the present invention.

As shown in FIG. 1 or FIG. 5, one of the projecting ends 3*a* of heat-radiating wires 3 (end 3*a* on the inlet side of the cooling air current formed by the cooling fan, to be described) is bent in L fashion towards the center. This enables the cooling air current flowing within the condenser to be stirred, making it possible to increase the heat exchange performance of the condenser.

As shown in FIG. 1, plates 5 for mounting the cooling fan, to be described, are welded at locations on the other projecting ends 3*b* of the heat-radiating wires 3 of the outermost layer which are bent in spiral fashion.

Figure 6:
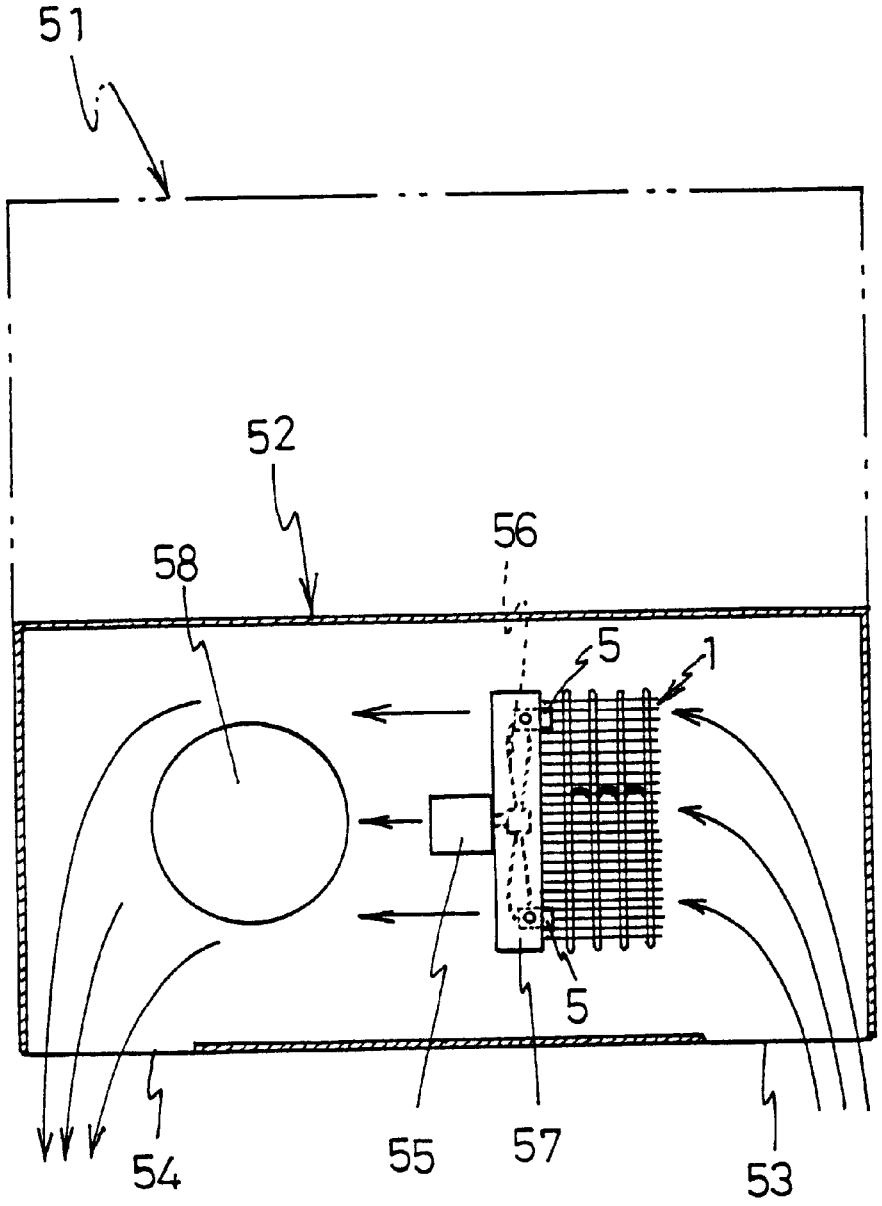
FIG. 6 is a diagrammatic cross-sectional view illustrating the condition in which the condenser of FIG. 1 for forced air-cooling according to the present invention is arranged in a refrigerator.

As shown in FIG. 6, condenser 1 for forced air-cooling according to the first embodiment of the present invention constructed as above is arranged within machinery compartment 52 formed in the lower part of refrigerator 51, so that it is subjected to forced air-cooling by the cooling fan.

Specifically, in FIG. 6, an external air intake port 53 is formed in the back face on the right-hand side of machinery compartment 52, and an external air exhaust port 54 is formed on the left-hand side of the back face. Thus, within this machinery compartment 52, a blower (cooling fan) 56 that is driven by motor 55 is arranged in the middle, and a condenser 1 for forced air-cooling according to the present invention, which is mounted and fixed through mounting plates 5 to flange 57 of blower 56 is arranged on the right-hand side of this blower 56. Also, compressor 58 of the cooling device is arranged on the left-hand side of blower 56.

In the above construction, when motor 55 of blower 56 is operated, external air is sucked in from intake port 53 of machinery compartment 52, and passes through condenser 1 for forced air-cooling according to the present invention, thereby subjecting this condenser 1 to air-cooling. After this, the external air passes through blower 56 to arrive at compressor 58, and, after air-cooling this compressor 58, is exhausted from exhaust port 54 (the flow of external air (cooling air current) during this process is shown by arrows in FIG. 6). In this way, condenser 1 for forced air-cooling according to the present invention and compressor 58 are subjected to forced air-cooling by external air.

A well known coolant circuit is constituted in which the coolant is compressed by compressor 58, is condensed to a liquid from a gas whilst passing through coolant pipe 2 of condenser 1 for forced air-cooling according to the present invention, and again returns to gas within an evaporator, not shown, before being fed to compressor 58.

Next, a second embodiment of a forced air-cooling condenser according to the present invention is described with reference to the drawings.

Figure 7:
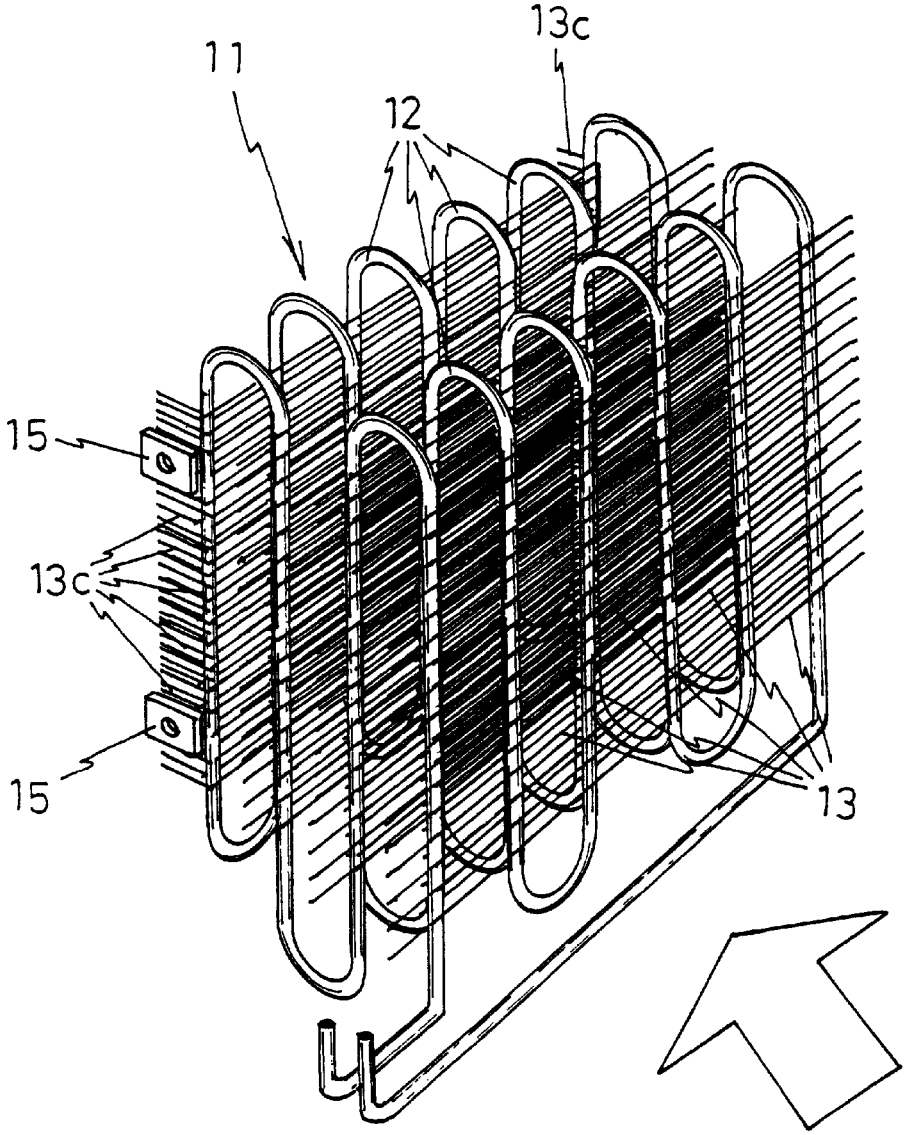
FIG. 7 is a perspective view illustrating a second embodiment of a forced air-cooling condenser according to the present invention.

FIG. 7 is a perspective view illustrating a second embodiment of a forced air-cooling condenser according to the present invention.

Figure 8:
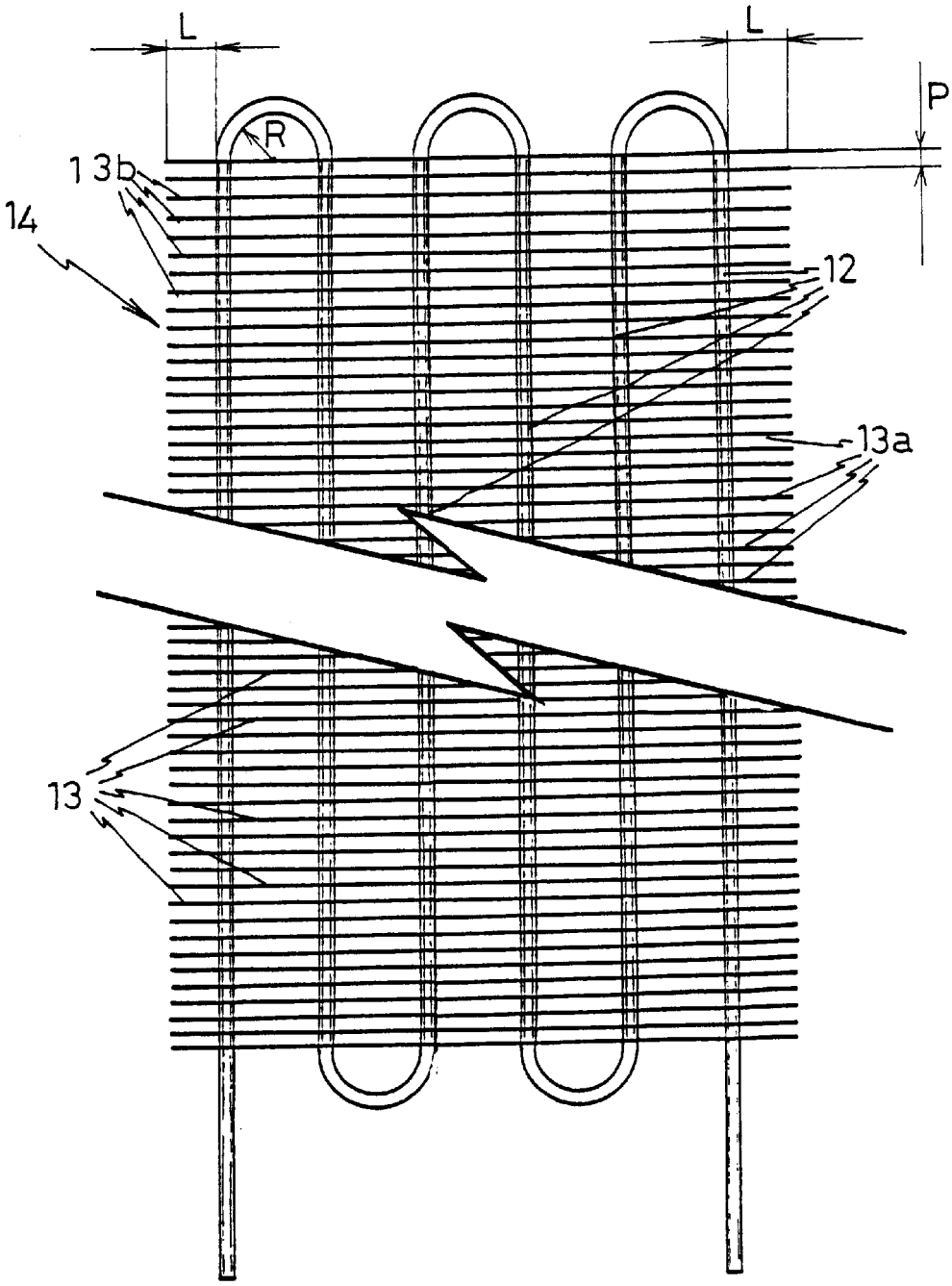
FIG. 8 is a plan view illustrating one condition in the process of manufacturing the condenser of FIG. 7 for forced air-cooling according to the present invention.

As shown in FIG. 8, in this condenser 11 for forced air-cooling, a large number of heat-radiating wires 13 extend across, above and below coolant pipe 12, which is bent back five times in bellows shape in the same plane, the regions of contact between coolant pipe 12 and heat-radiating wires 13 being fixed by welding; first of all a flat plate-shaped condenser 14 is produced, then this flat plate-shaped condenser 14 is alternately bent in positions separated by the same distance in the opposite direction from above as shown in FIG. 8 and, as shown in FIG. 7, as a whole is thereby constituted as a condenser of bellows form bent back three times.

In attachment of the heat-radiating wires 13 to coolant pipe 12, as shown in FIG. 8, the ends 13*a* and 13*b* of heat-radiating wires 13 are attached in a condition projecting at the side of coolant pipe 12 positioned at both respective ends thereof. In this way, the length of heat-radiating wires 13 can be increased, and the heat-radiating portion thereof can be increased.

As shown in FIG. 8, the projecting lengths L of the respective ends 13*a* and 13*b* of these heat-radiating wires 13 are preferably made at least 0.5 times the radius of curvature R when coolant pipe 12 is bent in bellows fashion.

Also, the attachment of heat-radiating wires 13 to coolant pipe 12 is such that these are attached alternately above and below coolant pipe 12 in same way as in the case of condenser 1 for forced air-cooling of the first embodiment of the present invention. Also, coolant pipe 12 may be subjected to flattening processing using rollers etc to make it elliptical in cross section. The heat-radiating wires 13 are then attached above and below to this coolant pipe 12 of elliptical cross section in same way as in the case of condenser 1 for forced air-cooling of the first embodiment of the present invention, thereby improving the heat exchange performance of the condenser.

The heat-radiating wires 13 that are attached to coolant pipe 12 are formed of metal of good thermal conductivity, such as iron, copper or aluminum. Taking into account weight and bending processing etc, their diameter is made 1.6 mm or less.

Figure 9:
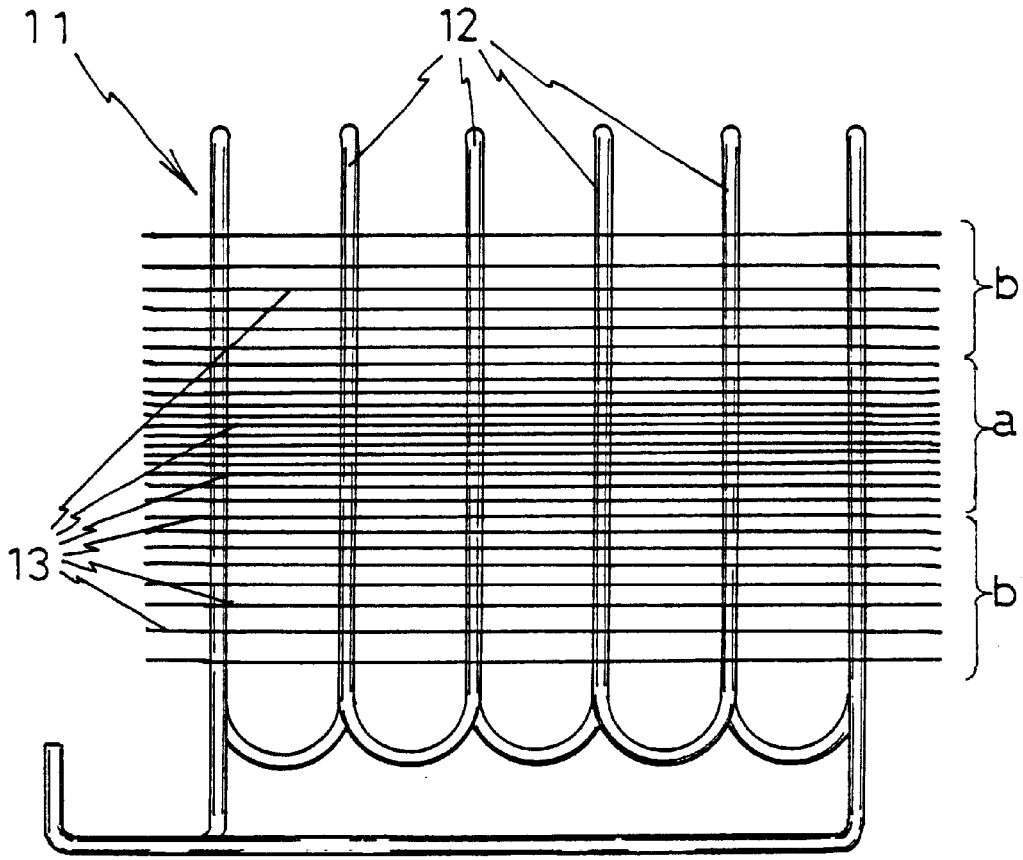
FIG. 9 is a front view of the condenser of FIG. 7 for forced air-cooling according to the present invention.

As shown in FIG. 9, the attachment of heat-radiating wires 13 to coolant pipe 12 is dense i.e. of small separation in the middle portion a where the cooling air current formed by the cooling fan, to be described, flows easily, and sparse i.e. of wide separation in the upper and lower portions b where the cooling air current flows with difficulty. In this way, the cooling air current can be efficiently brought into contact with the heat-radiating wires 13, thereby enabling the heat exchange performance of the condenser to be improved.

Also, the heat-radiating wires 13 are attached to the coolant pipe 12 with the variation of density described above, but their attachment pitch being in the range 3 to 7 mm.

Also, as shown in FIG. 7, projecting ends 13*c* of heat-radiating wires 13 in the rear (on the side that is mounted and fixed to the cooling fan, to be described) are bent rearwards in an L-shape, and plates 15 for mounting on to the cooling fan, to be described, are welded thereon at these locations.

Figure 10:
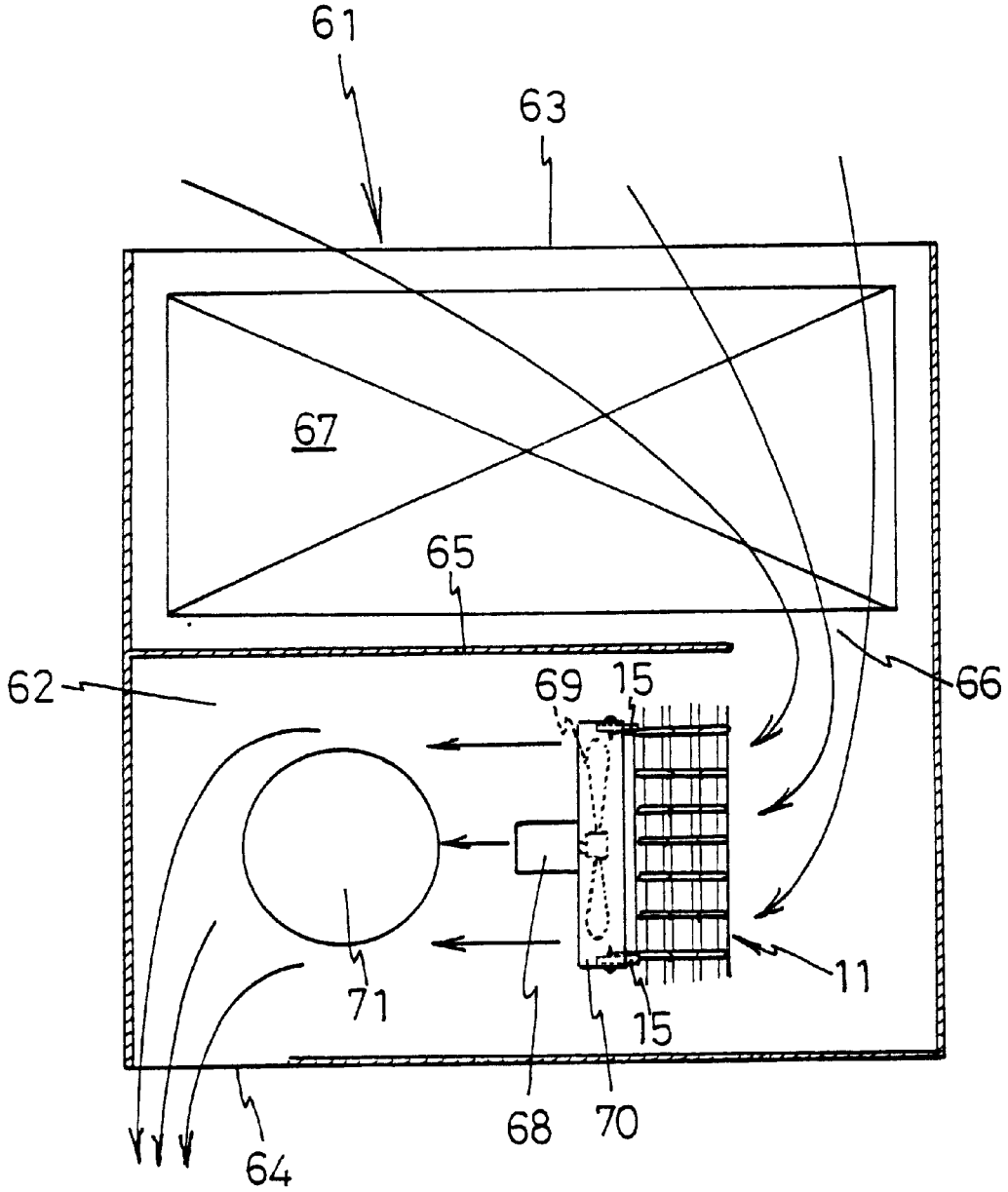
FIG. 10 is a diagrammatic cross-sectional view illustrating the condition in which the condenser of FIG. 7 for forced air-cooling according to the present invention is arranged in a refrigerator.

As shown in FIG. 10, condenser 11 for forced air-cooling according to the second embodiment of the present invention constructed as above is provided as an auxiliary condenser within the machinery compartment 62 formed in the lower part of refrigerator 61, and is subjected to forced air-cooling by a cooling fan.

Specifically, in FIG. 10, an external air inlet port 63 is formed on the front face side of machinery compartment 62, and an external air exhaust port 64 is formed on the left-hand side of the rear face. Also, the interior of this machinery compartment 62 is partitioned into front and rear by a partition 65; the front and rear of this partition 65 are connected at a communication portion 66 on the right-hand side of partition 65. At the front side of this partition 65, there is arranged a plate condenser 67 constituting a main condenser. Also, a blower (cooling fan) 69 that is operated by a motor 68 is arranged in the middle on the rear side of partition 65; on the right-hand side of this blower 69, there is provided a condenser 11 for forced air-cooling according to the present invention constituting an auxiliary condenser mounted and fixed by means of mounting plates 15 on flange 70 of blower 69. Also, a cooling device compressor 71 is arranged on the left-hand side of blower 69.

With the above construction, when motor 68 of blower 69 is operated, external air is taken in from intake port 63 of machinery compartment 62, and passes plate condenser 67 constituting the main condenser, thereby subjecting this plate condenser 67 to air-cooling. External air flows in on the rear side of partition 65 through communication portion 66, passing through condenser 11 for forced air-cooling according to the present invention, thereby subjecting this condenser 11 to air-cooling. After this, the external air arrives at compressor 71 through blower 69, and is exhausted from exhaust port 64 after air-cooling this compressor 67 (the flow of external air (cooling air current) in this process is shown by arrows in FIG. 10). In this way, plate condenser 67, which is the main condenser, condenser 11 for forced air-cooling according to the present invention, which is the auxiliary condenser, and compressor 71 are forcibly air-cooled by external air.

A well known coolant circuit is constituted in which the coolant is compressed by compressor 71, is condensed to a liquid from a gas whilst passing through the coolant pipes of condenser 11 for forced air-cooling according to the present invention and plate condenser 67, which is the main condenser, and again returns to gas within an evaporator, not shown, before being fed to compressor 71.

Although the present invention has been described above with reference to embodiments, the invention is not restricted to the above embodiments in any way.

For example, although, in the above embodiments, as shown in FIG. 1 or FIG. 5, a condenser 1 for forced air-cooling was described which was bent into a frustrum-shaped spiral configuration, a forced air-cooling condenser could be employed which is bent into a triangular, quadrilateral or circular spiral configuration, or a forced air-cooling condenser could be employed in which a large number of heat-radiating wires are attached extending above and below a coolant pipe bent back only once in bellows fashion, this being bent into a spiral configuration as a whole.

Figure 11:
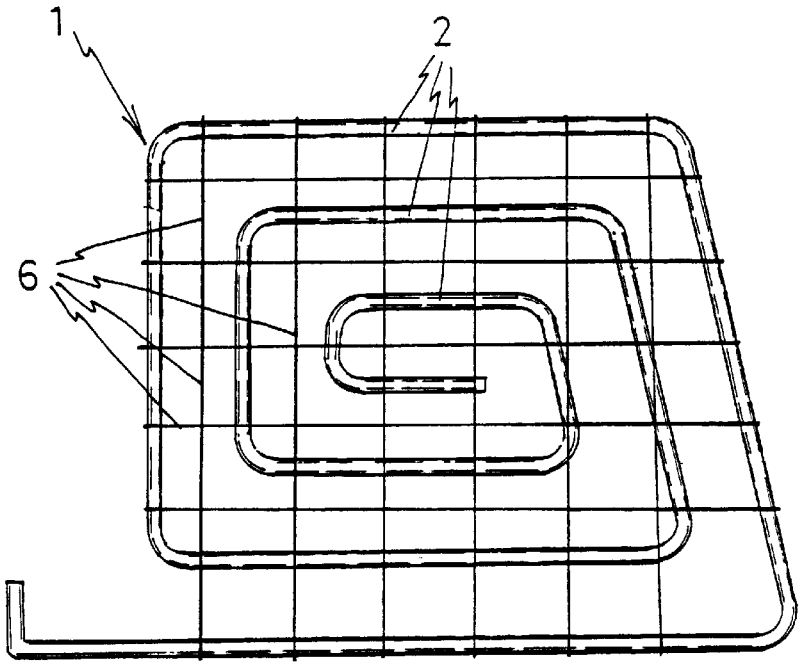
FIG. 11 is a front view illustrating a modified example of the condenser of FIG. 1 for forced air-cooling according to the present invention.
Figure 12:
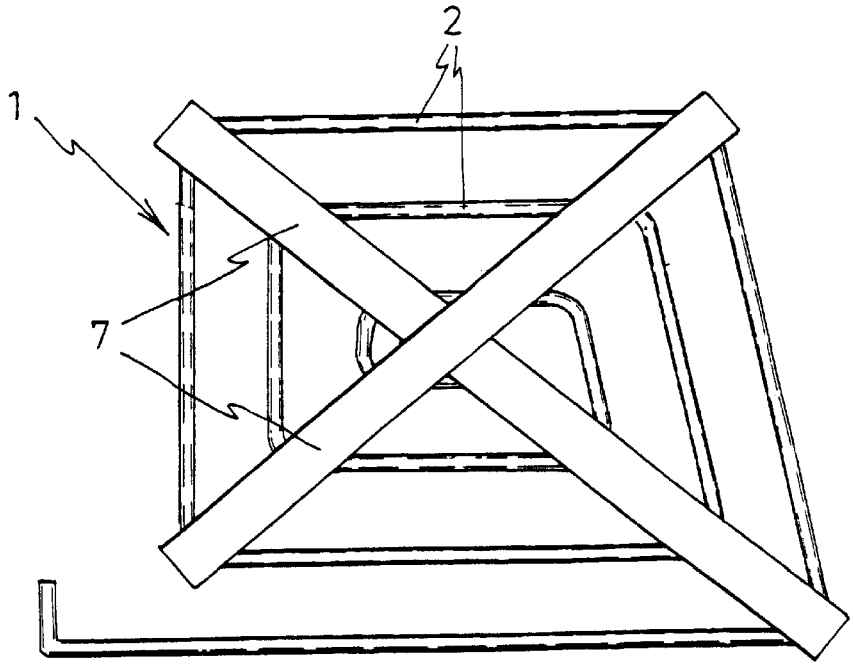
FIG. 12 is a front view illustrating another modified example of the condenser of FIG. 1 for forced air-cooling according to the present invention.
Figure 13:
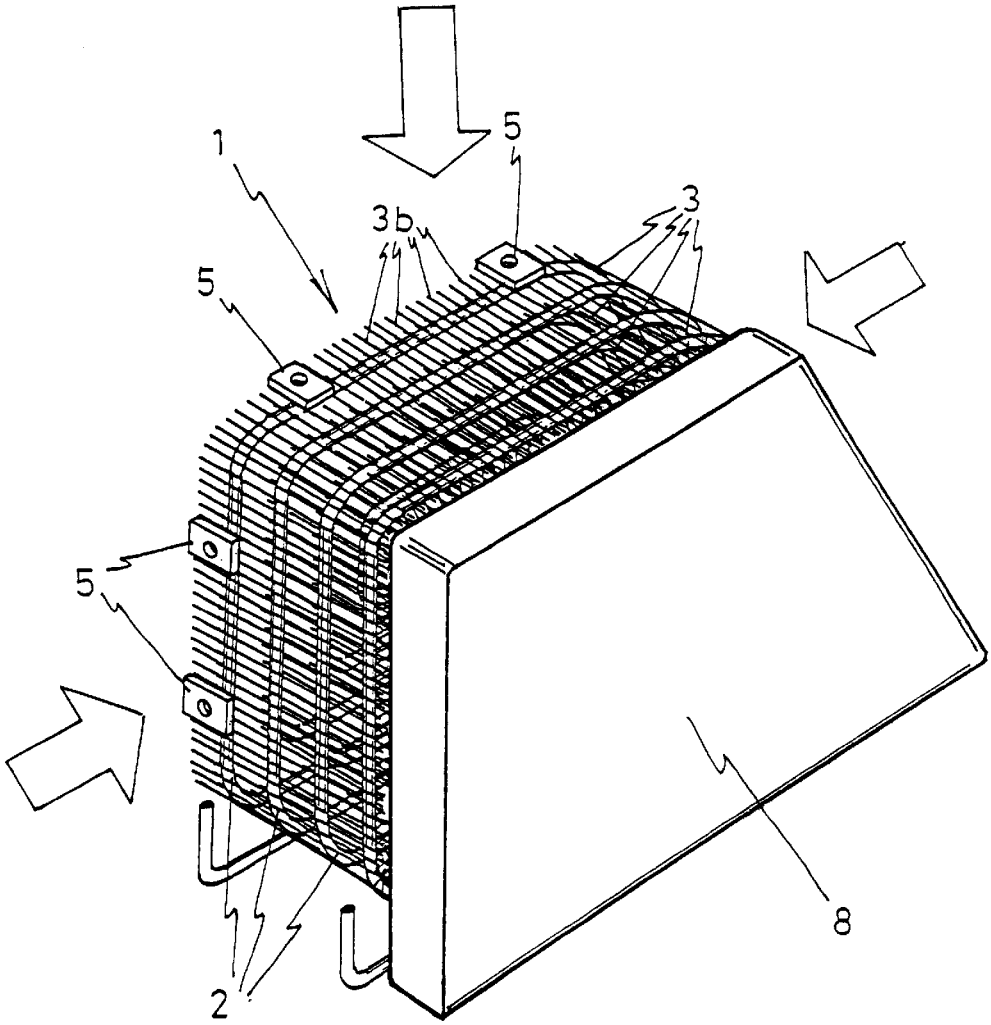
FIG. 13 is a front view illustrating yet another modified example of the condenser of FIG. 1 for forced air-cooling according to the present invention.
Figure 14:
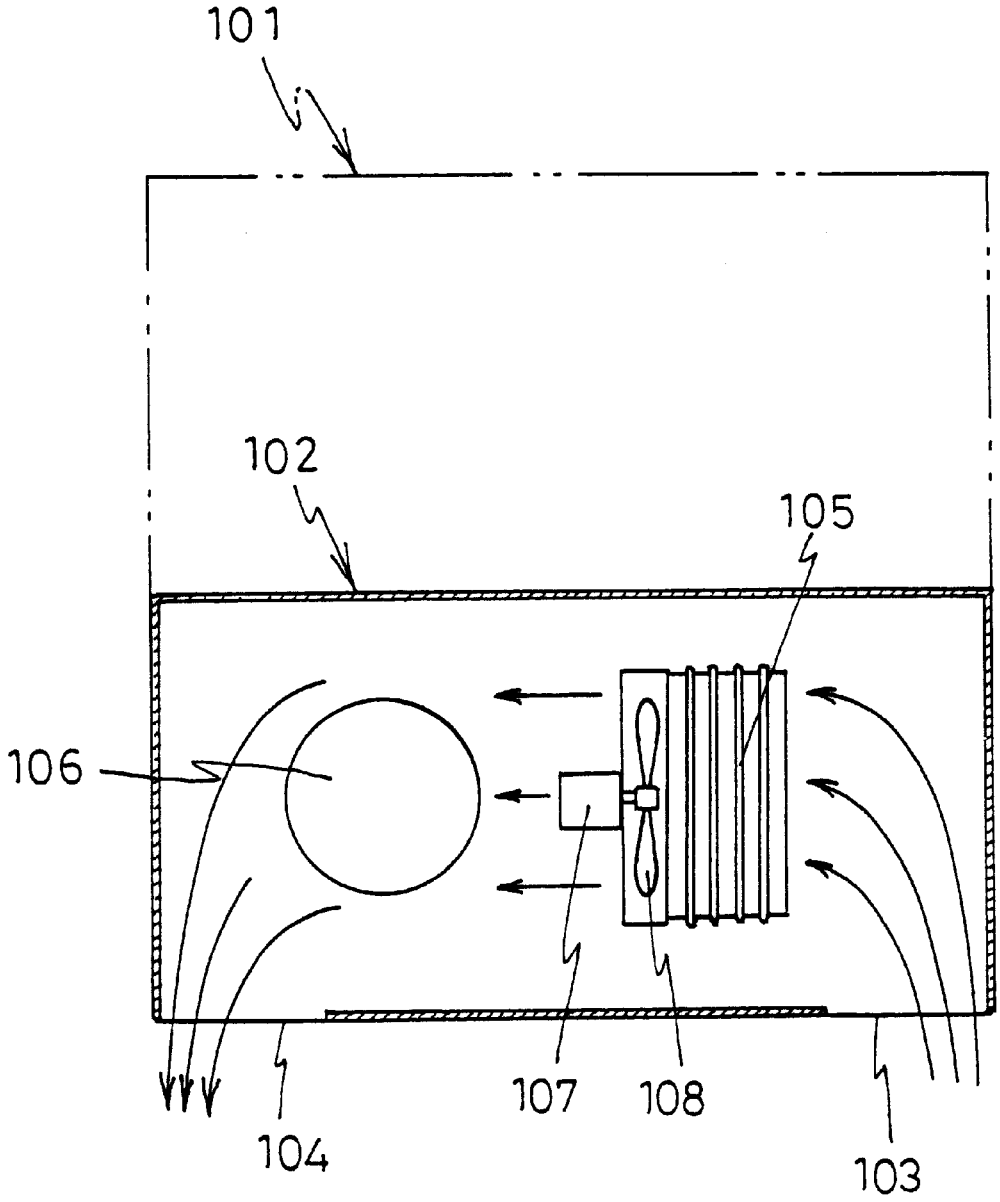
FIG. 14 is a diagrammatic cross-sectional view illustrating the condition of arrangement of a conventional forced air-cooling condenser in a refrigerator.
Figure 15:
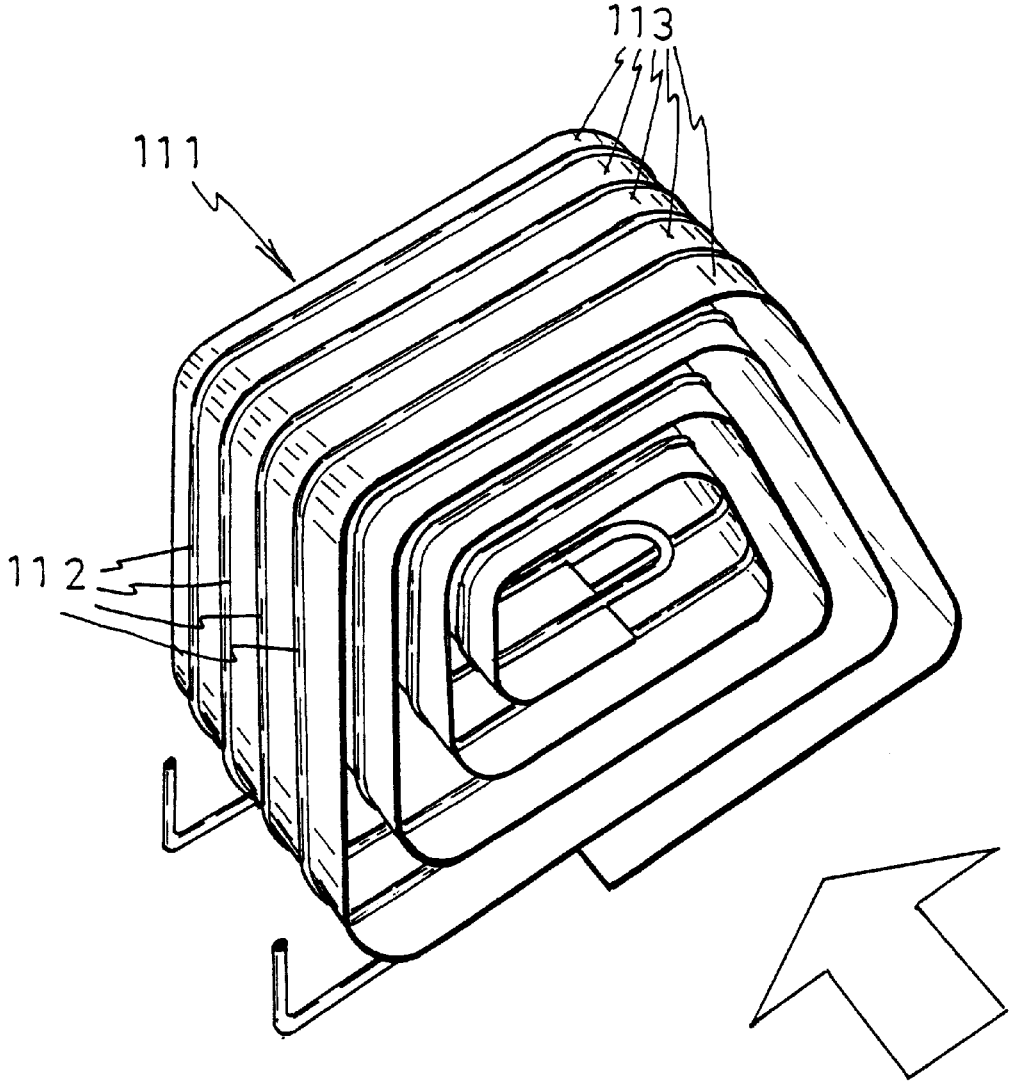
FIG. 15 is a perspective view illustrating an example of a conventional forced air-cooling condenser.
Figure 16:
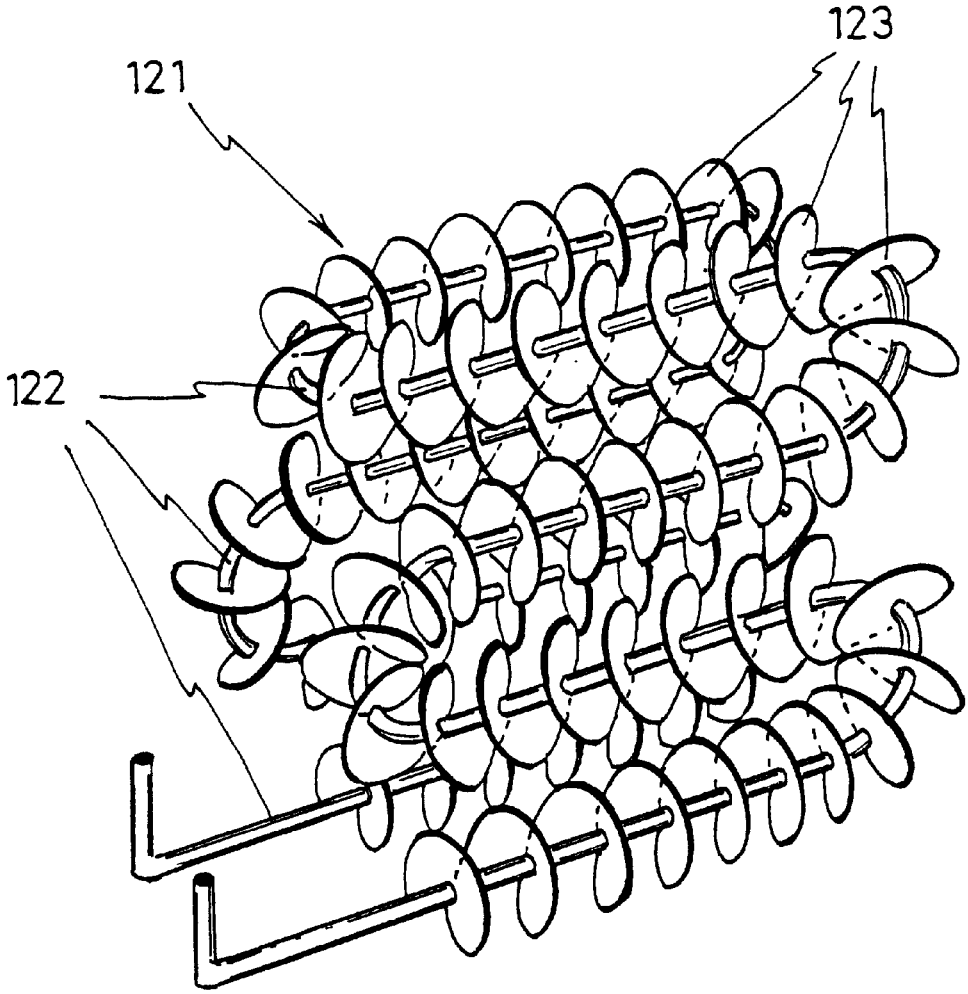
FIG. 16 is a perspective view illustrating another example of a conventional forced air-cooling condenser.

Also, although, in the above embodiment, as shown in FIG. 5, the projecting ends 3*a* of heat-radiating wires 3 on the inlet side of the cooling air current formed by the cooling fan constituted the means for stirring the cooling air current by being bent back in L fashion towards the middle, it would be possible, as shown in FIG. 11, for a further set of wires 6 to be arranged and fixed in a grid fashion at a location on the inlet side of the cooling air current to the condenser, or, as shown in FIG. 12, for strip-shaped plates 7 to be arranged and fixed in a crossing fashion at a location on the inlet side of the cooling air current of the condenser. Furthermore, depending on the case, as shown in FIG. 13, the entire aperture region of the spiral configuration may be blocked by a resin cover 8, so that the cooling air current formed by the cooling fan is caused to flow in from the side of the condenser.

Furthermore, although, in the above embodiments, as a means for mounting and fixing onto the cooling fan, the case of welding and fixing plates 5 or 15 to the heat-radiating wires was described, there is no restriction to this and fixing could be effected simply by welding nuts or wires etc bent into U shape to the heat-radiating wires.

Also, although, in the above embodiments, the case was described in which condenser 1 for forced air-cooling which was as a whole bent in spiral fashion was employed on its own as a condenser in which coolant was condensed, and also the case was described in which condenser 11 for forced air-cooling which was as a whole bent in bellows fashion was employed as a so-called auxiliary condenser, it would of course be possible for condenser 1 for forced air-cooling which was as a whole bent in spiral fashion to be employed as an auxiliary condenser or, contrariwise, for condenser 11 for forced air-cooling which was as a whole bent in bellows fashion to be employed on its own as a condenser in which coolant is condensed.

With a forced air-cooling condenser according to the present invention as described above, since wires are employed as the so-called heat-radiating fins, the overall weight can be reduced compared with a condenser of the skin type, and the coolant pipe can be bent with a smaller radius of curvature than with a condenser of the spiral fin type. Furthermore, since the coolant pipe is bent back in bellows fashion in the same plane and this is then as a whole bent in spiral fashion or bellows fashion, the benefit is obtained that a condenser can be obtained which is compact and yet has high heat exchange performance.

What is claimed is:

1. A forced air-cooling condenser employed in a refrigerator that is designed to forcibly cool a condenser thereby condensing coolant contained in a coolant pipe by using a cooling fan, wherein the coolant pipe is bent back in bellows fashion in a single plane, the bent cooling pipe is further bent into a spiral shape to form a three-dimensional structure including a plurality of parallel spirals, and a large number of heat-radiating wires are attached above or below the coolant pipe in an alternating pattern, the heat-radiating wires extending across the bent cooling pipe within the single plane.

2. The forced air-cooling condenser according to claim 1, wherein the cross-section of said coolant pipe is elliptical.

3. The forced air-cooling condenser according to claim 1, wherein the diameter of said heat-radiating wire is 1.6 mm or less and the pitch of attachment of these heat-radiating wires to said coolant pipe is 3 to 7 mm.

4. The forced air-cooling condenser according to claim 1, wherein the ends of said heat-radiating wires respectively project on the side of said cooling pipe positioned at the opposite ends.

5. A forced air-cooling condenser employed in a refrigerator that is designed to forcibly cool a condenser thereby condensing coolant contained in a coolant pipe by using a cooling fan, wherein the coolant pipe is bent back in bellows fashion in a single plane, the bent cooling pipe is further bent into a spiral shape, and a large number of heat-radiating wires are attached above and below the coolant pipe, the heat-radiating wires extending across the bent cooling pipe within the single plane, and the heat-radiating wires are provided with means for mounting and fixing the heat-radiating wires onto the cooling fan.

6. A forced air-cooling condenser employed in a refrigerator that is designed to forcibly cool a condenser thereby condensing coolant contained in a coolant pipe by using a cooling fan, wherein the coolant pipe is bent back in bellows fashion in a single plane, the bent cooling pipe is further bent into a spiral shape, and heat-radiating wires are attached above and below the coolant pipe, the heat-radiating wires extending across the bent cooling pipe within the single plane, and at a location on an inlet side where a cooling air current formed by the cooling fan flows into the condenser, there is provided means for stirring the flow of the cooling air current.

7. A forced air-cooling condenser employed in a refrigerator that is designed to forcibly cool a condenser thereby condensing coolant contained in a coolant pipe by using a cooling fan, wherein the coolant pipe is bent back in bellows fashion in a single plane, the bent cooling pipe is further bent into a spiral shape, and a large number heat-radiating wires are attached above and below the coolant pipe, the heat-radiating wires extending across the bent coolant pipe within the single plane, and a cover that prevents inflow to the condenser of a cooling air current formed by the cooling fan is provided on one side of an aperture of the spiral shape.

8. A forced air-cooling condenser employed in a refrigerator that is designed to forcibly cool a condenser thereby condensing coolant contained in a coolant pipe by using a cooling fan, wherein the coolant pipe is bent back in bellows fashion in a single plane, and a large number of heat-radiating wires are attached above and below the coolant pipe, the heat-radiating wires extending across the bent cooling pipe within the single plane, and the heat-radiating wires are provided with means for mounting and fixing the heat-radiating wires onto the cooling fan.

* * * * *